US011084040B1

(12) United States Patent
Sontag

(10) Patent No.: US 11,084,040 B1
(45) Date of Patent: Aug. 10, 2021

(54) GRINDER

(71) Applicant: Glennon C. Sontag, St. Louis, MO (US)

(72) Inventor: Glennon C. Sontag, St. Louis, MO (US)

( * ) Notice: Subject to any disclaimer, the term of this patent is extended or adjusted under 35 U.S.C. 154(b) by 163 days.

(21) Appl. No.: 16/451,657

(22) Filed: Jun. 25, 2019

Related U.S. Application Data

(62) Division of application No. 14/621,770, filed on Feb. 13, 2015, now Pat. No. 10,376,894.

(60) Provisional application No. 61/939,879, filed on Feb. 14, 2014.

(51) Int. Cl.

| | |
|---|---|
| ***B02C 13/288*** | (2006.01) |
| ***B02C 23/18*** | (2006.01) |
| ***B02C 13/16*** | (2006.01) |
| ***B02C 13/282*** | (2006.01) |
| ***B02C 13/14*** | (2006.01) |

(52) U.S. Cl.
CPC ..... *B02C 13/288* (2013.01); *B02C 13/14* (2013.01); *B02C 13/16* (2013.01); *B02C 13/282* (2013.01); *B02C 23/18* (2013.01)

(58) Field of Classification Search
CPC ..... B02C 13/14; B02C 13/16; B02C 13/18; B02C 13/1807; B02C 13/1814; B02C 13/185; B02C 13/205; B02C 13/28; B02C 13/2804; B02C 13/282; B02C 13/288; B02C 13/30; B02C 2013/1871; B02C 2013/1878; B02C 2013/2808; B02C 2013/2825; B02C 23/24; B02C 25/00
USPC ..... 241/19, 33, 275, 286
See application file for complete search history.

(56) References Cited

U.S. PATENT DOCUMENTS

| | | | |
|---|---|---|---|
| 1,566,546 | A | 12/1925 | Lauritzen |
| 1,728,976 | A | 9/1929 | Nobis |
| 1,772,974 | A | 8/1930 | White |
| 1,975,406 | A | 10/1934 | Reschke |

(Continued)

FOREIGN PATENT DOCUMENTS

| | | | |
|---|---|---|---|
| GB | 159925 | A | 3/1921 |
| WO | 2013167398 | A1 | 11/2013 |

OTHER PUBLICATIONS

International Preliminary Report on Patentability in International Application No. PCT/US2016/017511.

*Primary Examiner* — Shelley M Self
*Assistant Examiner* — Katie L. Parr
(74) *Attorney, Agent, or Firm* — Grace J. Fishel

(57) ABSTRACT

A grinder having a rotor and fan assembly mounted in a housing having one or more of the following features: a cutting shaft and a fan shaft which are concentric and are rotated by separate motors; a housing formed in two sections with a line of division passing through the axis of rotation of the shafts and mounted on rollers; ping pong shaped cutting hammers; and deflectors attached to the inside of the housing and to a deflector assembly on the outside of the housing. The deflectors are movable vertically and horizontally with first and second motion controllers for adjusting the spacing between the cutting hammers and the deflectors. A programmable logic controller is used for independently controlling the speed at which the cutting shaft and fan shaft are rotated and the spacing between the cutting hammers and the deflectors to produce a desired particle size reduction for a selected material.

12 Claims, 15 Drawing Sheets

(56) References Cited

U.S. PATENT DOCUMENTS 2,038,594 A 4/1936 Nichols
2,041,188 A 5/1936 Johnson
2,072,920 A 3/1937 Holland
2,287,659 A 6/1942 Bindner
2,350,737 A 6/1944 Eiben
2,440,285 A * 4/1948 Lykken ..... B02C 13/14 241/56
2,734,687 A 2/1956 Draves
2,922,589 A 1/1960 Sheldon
2,976,717 A 3/1961 Davoust
3,058,676 A 10/1962 Hermann
3,982,702 A 9/1976 Barnhart et al.
4,009,836 A * 3/1977 Strom ..... B02C 13/04 241/73
4,083,502 A 4/1978 Dittman
4,151,794 A 5/1979 Burkett
4,218,024 A * 8/1980 Pallmann ..... B02C 18/186 144/218
4,339,085 A 7/1982 Williams
4,404,640 A 9/1983 Dumbeck et al.
4,600,157 A 7/1986 Willach et al.
4,619,409 A * 10/1986 Harper ..... B02C 13/288 241/38
4,673,134 A 6/1987 Barthelmess
4,988,045 A 1/1991 Griesedieck et al.
4,998,678 A 3/1991 Durr
5,090,631 A 2/1992 Wark
5,186,404 A 2/1993 Wark
5,192,029 A 3/1993 Harris
5,238,196 A 8/1993 Chang
5,680,994 A 10/1997 Eide
5,732,894 A * 3/1998 Sheahan ..... B02C 13/18 241/154
5,911,375 A 6/1999 Isfort
6,092,748 A 7/2000 Keyssner et al.
6,742,732 B1 6/2004 Hundt et al.
7,950,601 B2 5/2011 Watts
8,360,349 B1 1/2013 Sotsky
8,366,031 B2 2/2013 Corner
8,777,142 B2 7/2014 Gronholz
8,813,967 B2 8/2014 Plant et al.
9,707,564 B2 7/2017 Mogan
10,799,873 B2 * 10/2020 Yunger ..... B02C 13/09
2009/0250539 A1 * 10/2009 Stelk ..... B02C 13/28 241/197
2010/0327096 A1 * 12/2010 Watts ..... B02C 13/282 241/56
2011/0215179 A1 9/2011 Watts
2012/0119003 A1 * 5/2012 Watts ..... B02C 23/28 241/30
2013/0043336 A1 2/2013 Watts
2014/0021890 A1 1/2014 Herrera
2014/0077009 A1 3/2014 Watts
2014/0077011 A1 3/2014 Watts
2014/0154080 A1 6/2014 Watts
2015/0190813 A1 * 7/2015 Dallimore ..... B02C 13/09 241/5
2016/0045919 A1 * 2/2016 McDaniel ..... B02C 13/18 241/191
2016/0228879 A1 8/2016 Scharfe

* cited by examiner

GRINDER

BACKGROUND OF THE INVENTION

1. Field of the Invention

The present invention relates to a grinder with a generally vertical, rotatable first shaft having at least one set of cutter discs driven thereby and a fan assembly mounted below the cutter blades on a second vertical, rotatable second shaft in position to receive output from the cutter blades. The first and second shafts are driven by separate motors. Other features will be apparent in view of the disclosure which follows.

2. Brief Description of the Prior Art

Grinders, shredders or mills are well known devices for reducing the particle size of a material. For example, U.S. Pat. No. 5,192,029 to Harris, U.S. Pat. No. 5,680,994 to Eide et al. and U.S. Pat. No. 7,950,601 to Watts disclose mills for grinding garbage. Each of these mills includes a rotor mounted in a octagonal housing. The rotor includes a generally vertical shaft and a plurality of blades mounted on the shaft. Garbage is admitted into the housing through an inlet near the top of the housing and is impacted by the blades of the rotor. Material of a reduced particle size is removed from the mill through an outlet near the bottom of the housing.

The mill of Eide et al. '994 and Watts '601 further includes a fan or impeller which is mounted on the same shaft as the cutter discs. The fan is intended to create airflow which acts to move material through the mill and to expel it from the outlet. The airflow from the fan also acts to remove moisture from the material as it is being ground. Since different materials and different grinding conditions produce different moisture levels in the material, it is advantageous if the rate of airflow can be adjusted.

In Watts '601 the airflow can be adjusted by repositioning the fan blades on the fan disc. This, however, requires opening up the grinder to access the fan blades which interferes with production throughput. In addition, the newly positioned blades may not produce the desired airflow and the process may need to be repeated until an acceptable result is achieved. In addition as mentioned above, different materials have different moisture levels and with the Watts '601 grinder it is not possible to adjust the airflow dynamically.

BRIEF SUMMARY OF THE INVENTION

In view of the above, it is an object of the present invention to provide a grinder wherein the airflow can be adjusted dynamically without disassembling the grinder. Another major object is to provide a grinder wherein the spacing between the cutter disks and the anvils may be adjusted without disassembling the grinder. Other objects and features of the invention will be in part apparent from the following disclosure and in part pointed out.

In accordance with the invention, a grinder of the general type discussed above includes a separate fan assembly. In an embodiment of the invention the fan assembly includes a fan disk with fan blades attached horizontally, angularly and outwardly from the fan disk toward the walls of side wear plates on the inside of the grinder. In some instances, the fan disk is mounted on a separate shaft concentric with the cutting shaft. The separate fan shaft with a separate motor allows for increasing or decreasing airflow through the grinder without opening up the grinder housing. For example, when the shaft for the fan assembly is connected to a motor rated at 3,600 rpm and the main cutting shaft is connected to a motor rated at 1,800 rpm, the two shaft speeds may be separately adjusted through an electronic interface. Using that interface, throughput may be maximized by adjusting the speed of either or both shafts.

In other embodiments, the grinder includes an automated angle deflector height adjustment. A Further automated enhancement includes a horizontal pneumatic two position actuator. When energized with a solenoid the horizontal positioner supplies 150 pound pressure to the deflectors to lock them against the interior wear plates. When the horizontal actuator is de-energized the actuator spring returns and the push rod moves the deflectors away from the interior walls. The vertical positioner can then move the deflectors to the desired height along the inside walls. The deflectors are therefore alternately unlocked to vertically position the anvil and then locked to secure the deflector to the interior wall for cutting. Previously, grinders had a mechanical height adjustment that required the removal or addition of washers between externally fixed mounting plates attached to vertically moveable deflectors on the exterior side plates to position an interior deflector up or down to produce a variable cut. This adjustment like adjusting the fan blades in the Watts '601 grinder cannot be done on the fly. In the subject embodiment of the present invention, a motion controller with position feedback is attached to an external bracket that moves an internal deflector. By adjusting the gap between the cutting hammers and the deflectors, the grinder may be preset for grinding wood, plastic, municipal solid waste, etc. to produce the desired particle size reduction. The appropriate conditions for each material may be stored in a processor as a recipe.

Further embodiments of the present invention include an improved automated control system including a processor (e.g., programmable logic controller (PLC)) and an electronic interface (e.g., human machine interface (HMI) touchscreen). The control system may be used to set the speed of the grinder main cutting shaft motor and then monitor the grinder shaft load in order to regulate the speed of in-feed and discharge conveyors. The cutting height between the cutting hammers and the deflectors may be selectable at the HMI touchscreen monitor as well as adjusting the separate fan assembly motor.

Other embodiments of the present invention make use of improved metallurgy. Previously the Watts '601 grinder, for example, was fabricated entirely of A36 carbon steel. Better performance is achieved by constructing the cutting hammers of AR400 steel alloy and constructing the cutting disks of A514 steel alloy. The cutting hammers formed of AR400 steel alloy withstand the harsh impact environment of the in-feed material and the cutting disks formed of A514 steel alloy do not deflect downward at high speeds, thereby reducing material stress and metal fatigue, and thus changing the gap between the cutting hammers and the deflectors. In one embodiment, the pins that attached the hammers to the cutter discs and/or the main cutting shaft are made of 4340 steel alloy which allows for higher speed operation. Still further improvements include forming removable interior wear plates as well as the cutting hammers from AR400 steel alloy to improve and increase wear life.

In an embodiment of the invention, the grinder housing is polygonal and formed in sections with flanges which are bolted together. To access the rotor the sections are mounted on rollers installed on a shell roller track by means of which the sections may be parted when the flanges are unbolted.

The invention partially summarized above comprises the constructions hereinafter described.

BRIEF DESCRIPTION OF THE SEVERAL VIEWS OF THE DRAWING

In the accompanying drawings, in which several of various possible embodiments of the invention are illustrated, corresponding reference characters refer to corresponding parts throughout the several views of the drawings in which.

Figure 14:
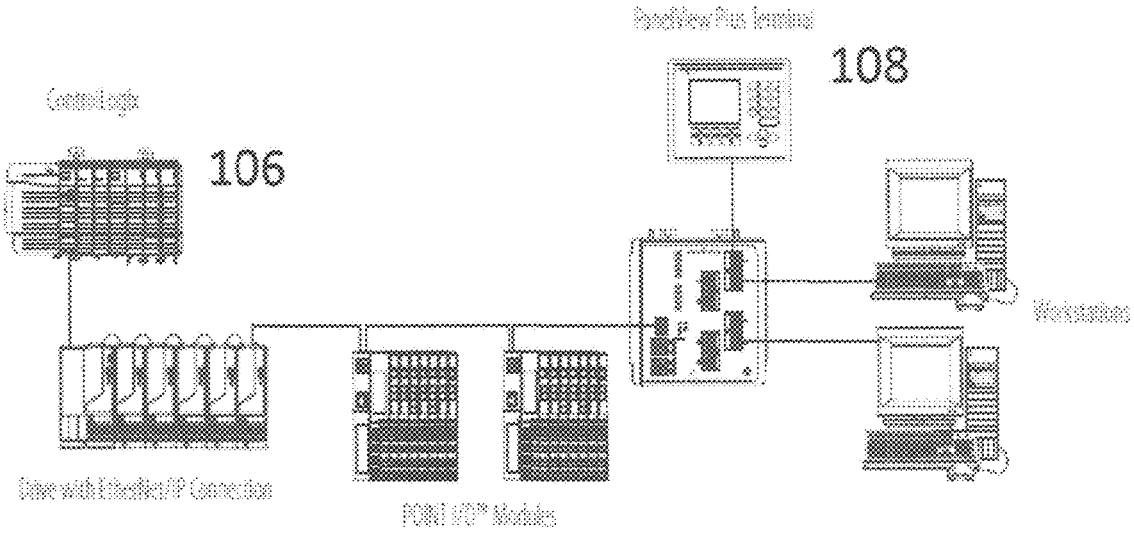

and,

FIG. 14 is a perspective view of a programmable logic controller and a human machine interface

DETAILED DESCRIPTION OF THE INVENTION

Figure 1:
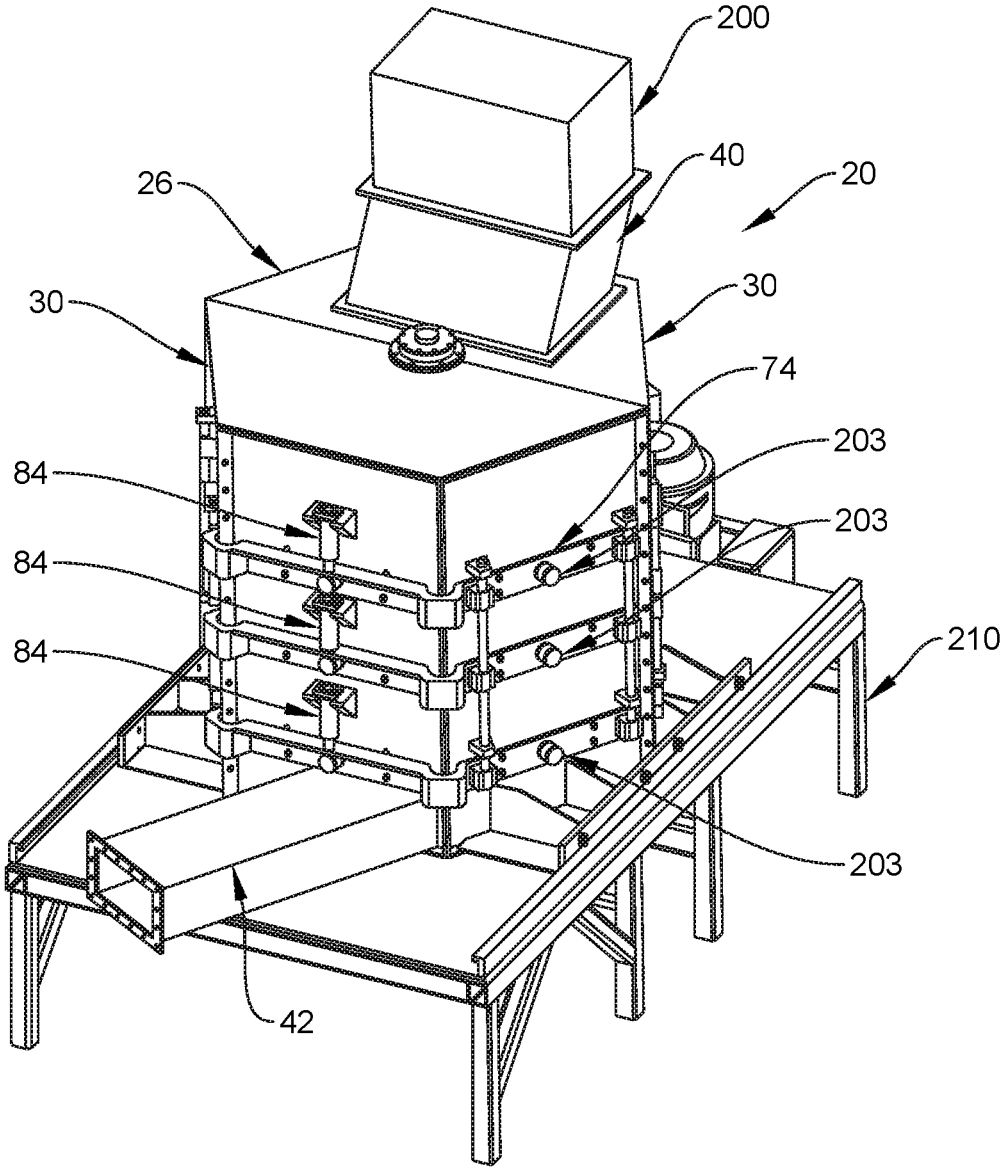
FIG. 1 is a perspective view of a grinder in accordance with the present invention mounted on a stand.
Figure 2:
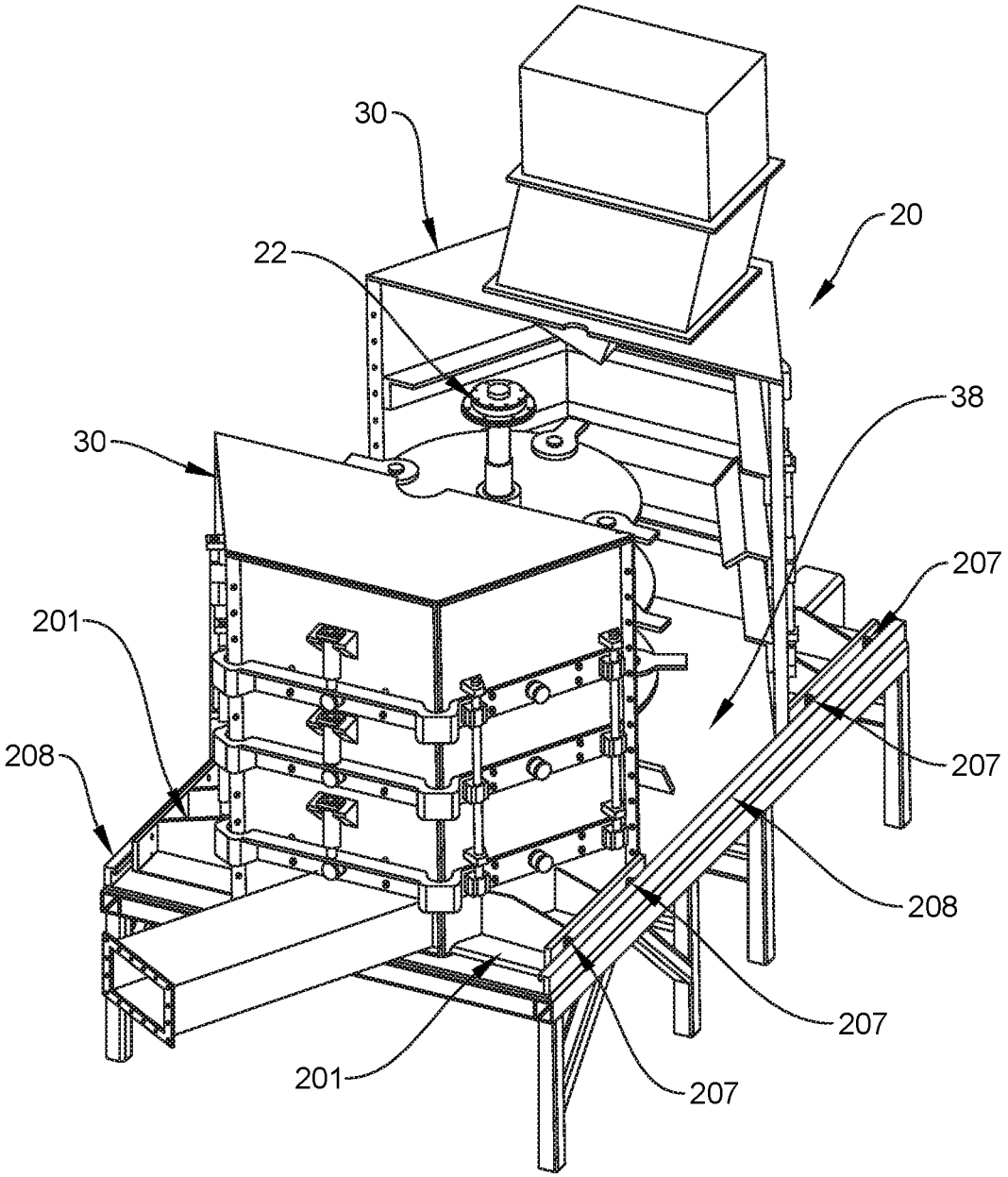
FIG. 2 is a perspective view with shell assembly separated.
Figure 3:
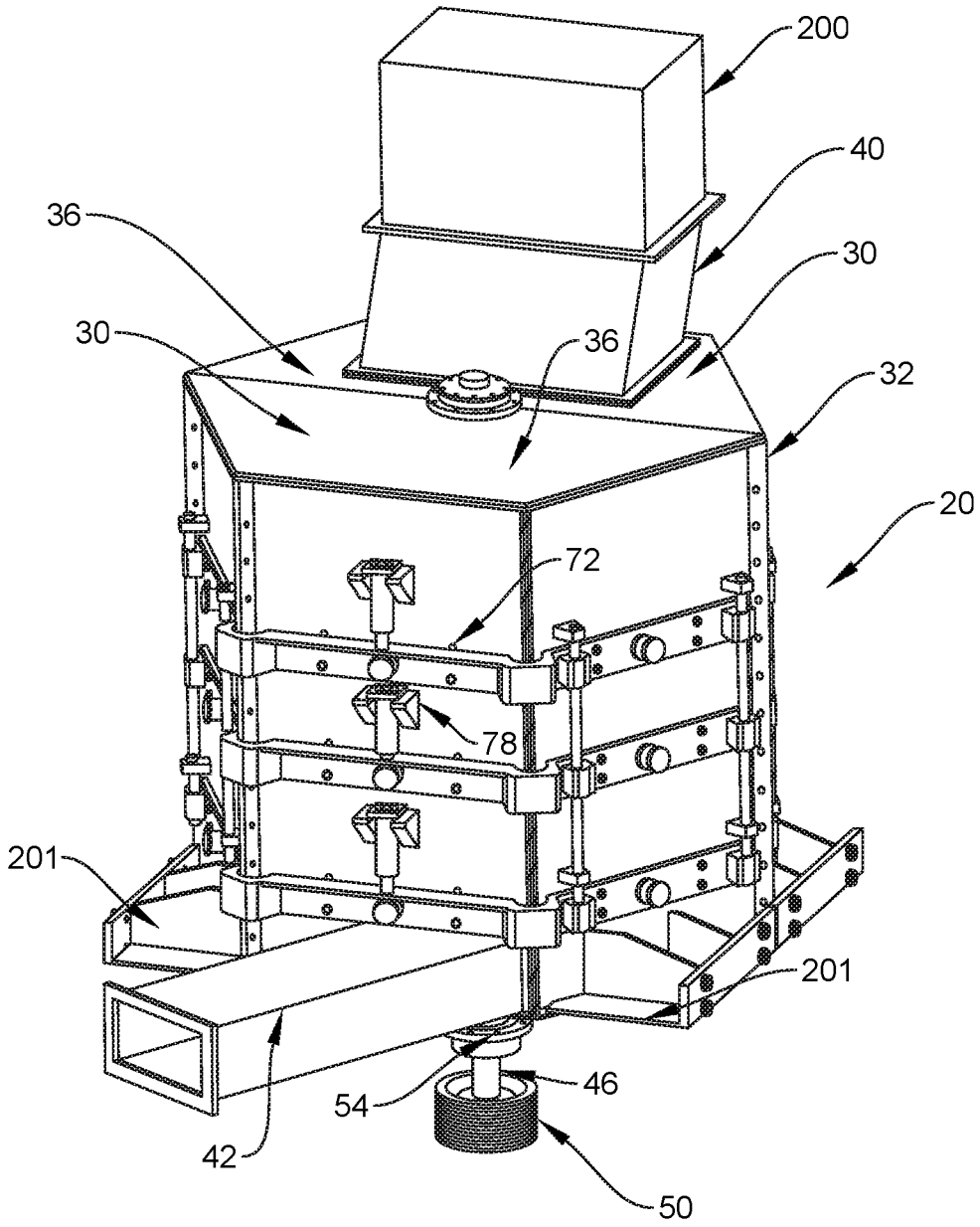
FIG. 3 is a perspective view of the grinder separated from the stand.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to the drawings more particularly by reference character, reference numeral 20 refers to a grinder in accordance with the present invention. Grinder 20 has a number of features which set it apart from Watts '601 mill which is believed to be the closest prior art. Those features are combined in grinder 20 but could be separately used to improve grinders of the general type discussed in the Brief Description of the Prior Art section and are therefore regarded as separately patentable.

Figure 4:
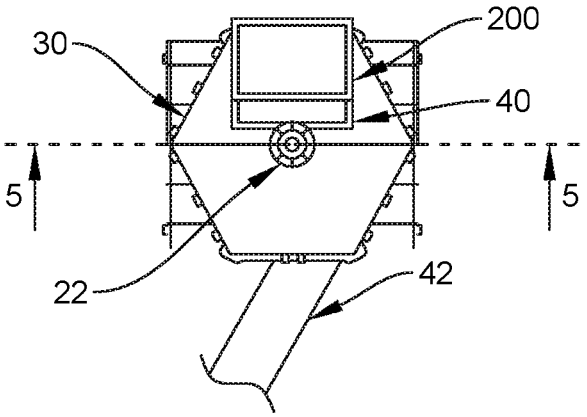
FIG. 4 is a top plan view of the grinder.

Grinder 20 includes a rotor 22 and a fan assembly 24 (FIG. 8) rotatably mounted in a housing 26. As illustrated, housing 26 is generally hexagonal in shape but could be octagonal, decagonal or other, preferably even numbered polygonal in shape. Housing 26 includes six exterior sidewall panels 28 which may be formed of A36 carbon steel. The six exterior sidewall panels 28 are joined into two horizontally movable shell assembly sections 30, each having three sides. Each section 30 has a shell flange 32 which extends vertically along the sides for connecting the sections together with bolts. The mating flanges 32 allow for a gasket material to be inserted forming a watertight seal. A line of division between sections 30 passes through an axis of rotation of rotor 22 (center point of rotor 22 seen in FIG. 4) to permit access to rotor 22 for installation and removal. For this purpose, both sections 30 are installed on a shell roller track 208 and shell rollers 207 by means of which a section may be parted from the other section when flanges 32 are unbolted. Housing 26 has a top wall 36 and a bottom wall 38 upon which shell roller track 208 is mounted. A feed stock input chute 40 is provided in top wall 36 and a reduced material discharge chute 42 is formed in a sidewall of housing 26 just above bottom wall 38. A chute hood 200 is mounted on feed stock input chute 40 for delivery of the feed stock into the input chute 40. Housing also includes six vertical interior removable wear plates 44 which may be formed of AR400 steel alloy for better wearability and which line the inside of sidewall panels 28.

A main cutting shaft 46 of rotor 22 is rotatably journaled in housing 26 by a motor 48 which may be, for example, electric or hydraulic and which may be connected to main cutting shaft 46 with a sheave pulley 50. An upper bearing 52 for main cutting shaft 46 is mounted on top wall 36. Similarly a lower bearing 54 is below bottom wall 38 immediately under concentric fan shaft driven sheave 96. Lower bearing 54 is supported by grinder support frame 210. Bearings 52 and 54 may be removable angular contact bearings instead of pillow blocks to provide a cost effective method for replacing the bearings and main cutting shaft 46 may be made of 4340 alloy steel to improve performance and wear at high speed.

A plurality of cutter discs 56, illustrated as three, are mounted on main cutting shaft 46, and denominated as discs 56*a*, 56*b* and 56*c*. Mounted on each disc 56 are cutting hammers 58. Discs 56 may be formed of A514 steel alloy which reduces the downward deflection of the discs at high speed as may occur with discs formed of other steel alloys. As illustrated, cutting hammers 58 are ping pong paddle in shape which allows for a more robust, wider end for attachment to discs 56. For example, a 3" hole may to drilled in cutting hammers 58 for attachment with a 3" connection device 60 to allow for a more secure connection to cutter discs 56. In addition, the curved paddle portion of cutting hammers 58 provides more hammer cutting surface producing more effecting cutting of the infeed material into bits. Cutting hammers 58 may be formed of AR400 steel alloy which is an improvement over the rectangular A36 steel bar stock used for the hammers in Watts '601 patent.

In one embodiment of grinder 20, illustrated in the drawings, disc 56*a* is smaller in diameter than disc 56*b* and four cutting hammers 58 are provided on discs 56*a* and 56*b* while disc 56*c* is outfitted with six cutting hammers 58. When top disc 56*a* is smaller than the second disc 56*b*, infeed material drops onto the second cutter disc 56*b*. This prevents the material from passing by the second disc 56*b* along interior wear plates 44 and is an improvement over the Watts '601 patent where the large diameter of top disc 56*a* prevented the material from dropping on second disc 56*b* for further grinding.

Figure 6:
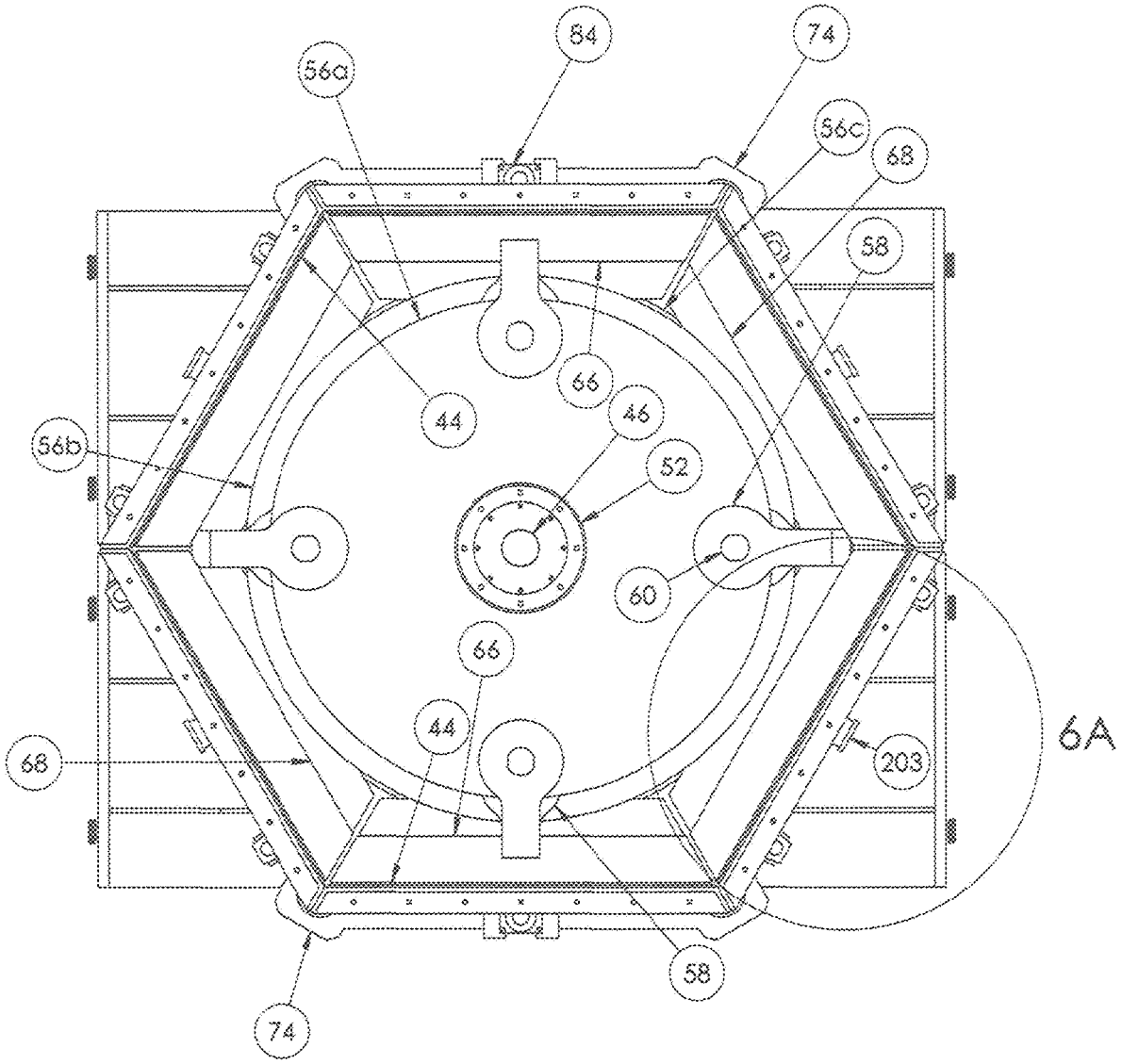
FIG. 6 is a sectional view taken along the plane of 6-6 in FIG. 5.
Figure 6A:
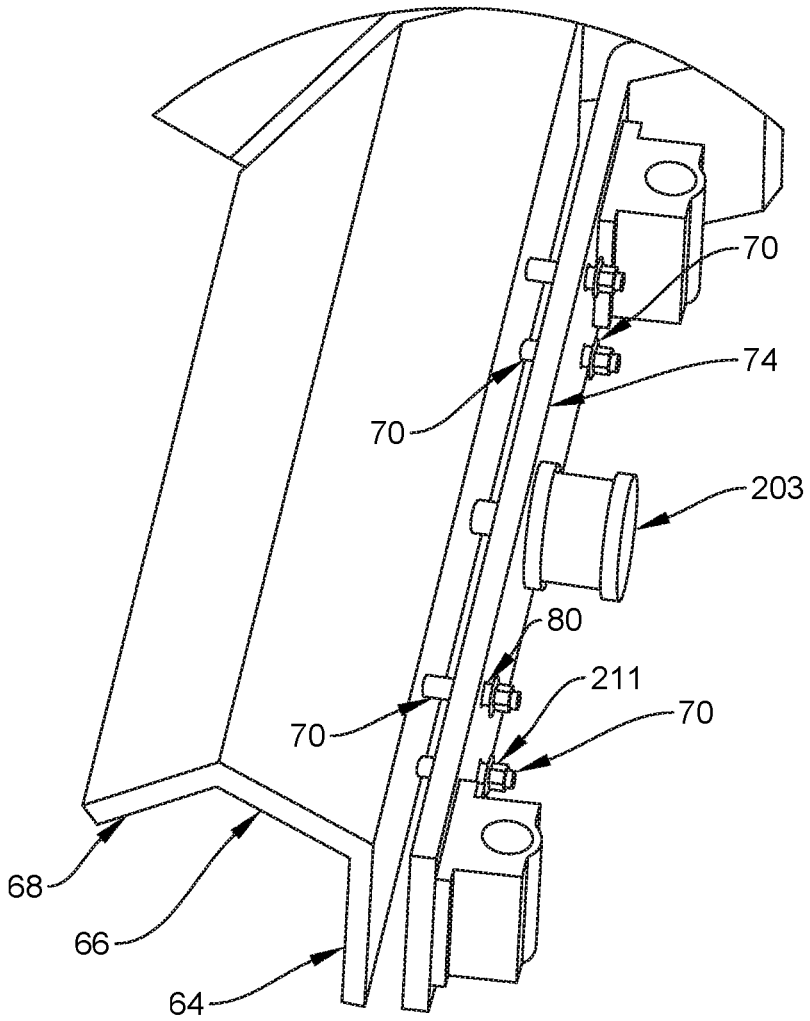
FIG. 6A is an enlarged view taken along the line 6A-6A in FIG. 6.
Figure 7:
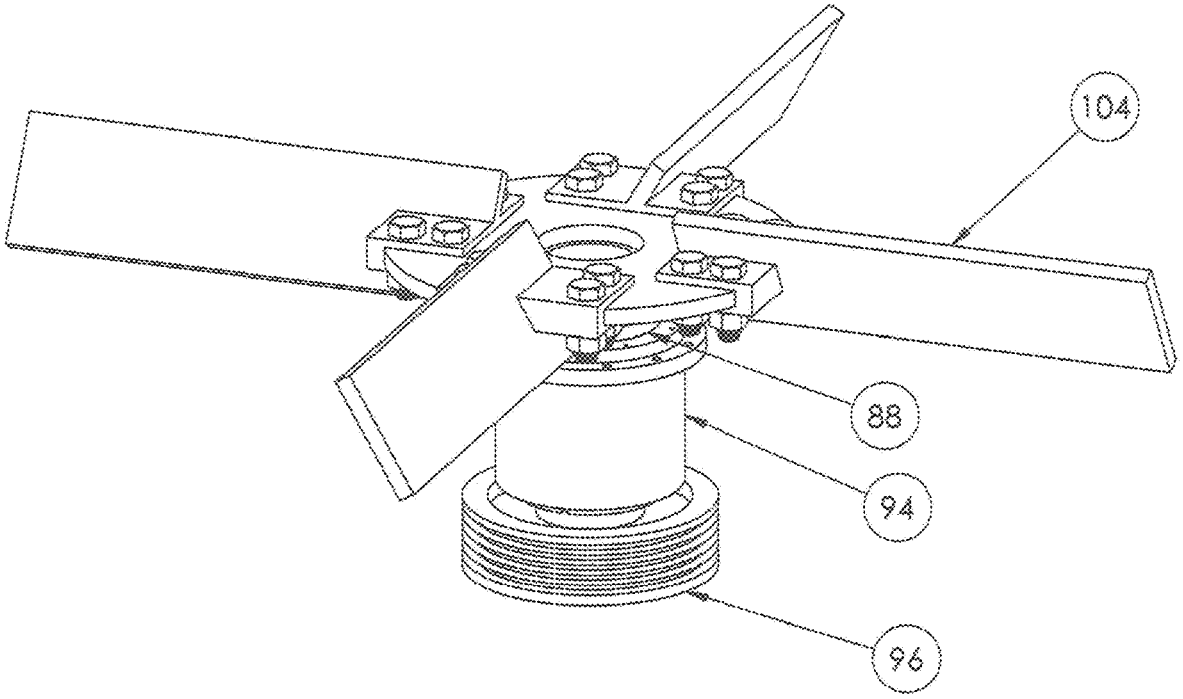
FIG. 7 is a perspective view of the concentric fan assembly on an enlarged scale.
Figure 8:
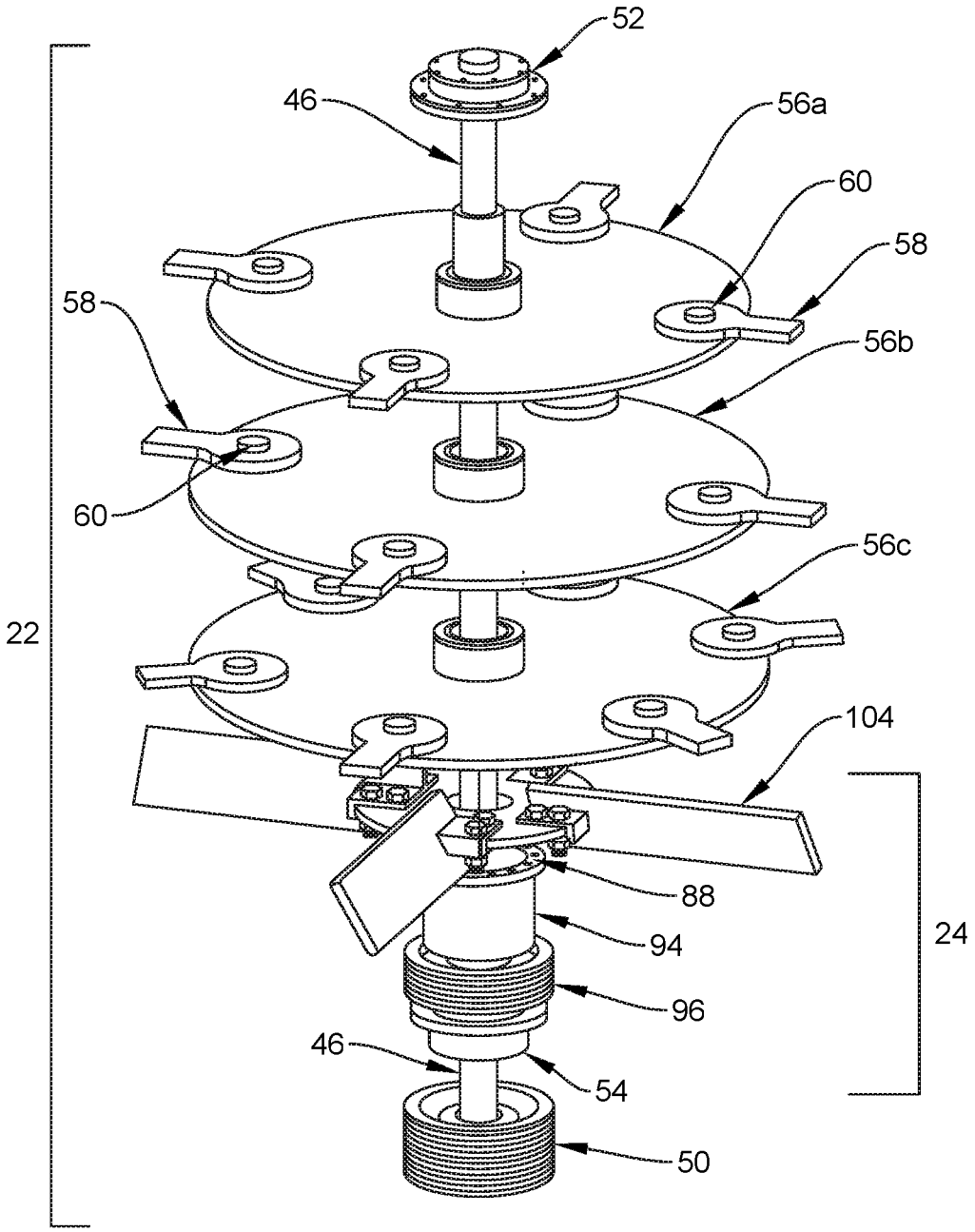
FIG. 8 is a perspective view of the main cutting shaft and the concentric fan shaft assemblies.
Figure 9:
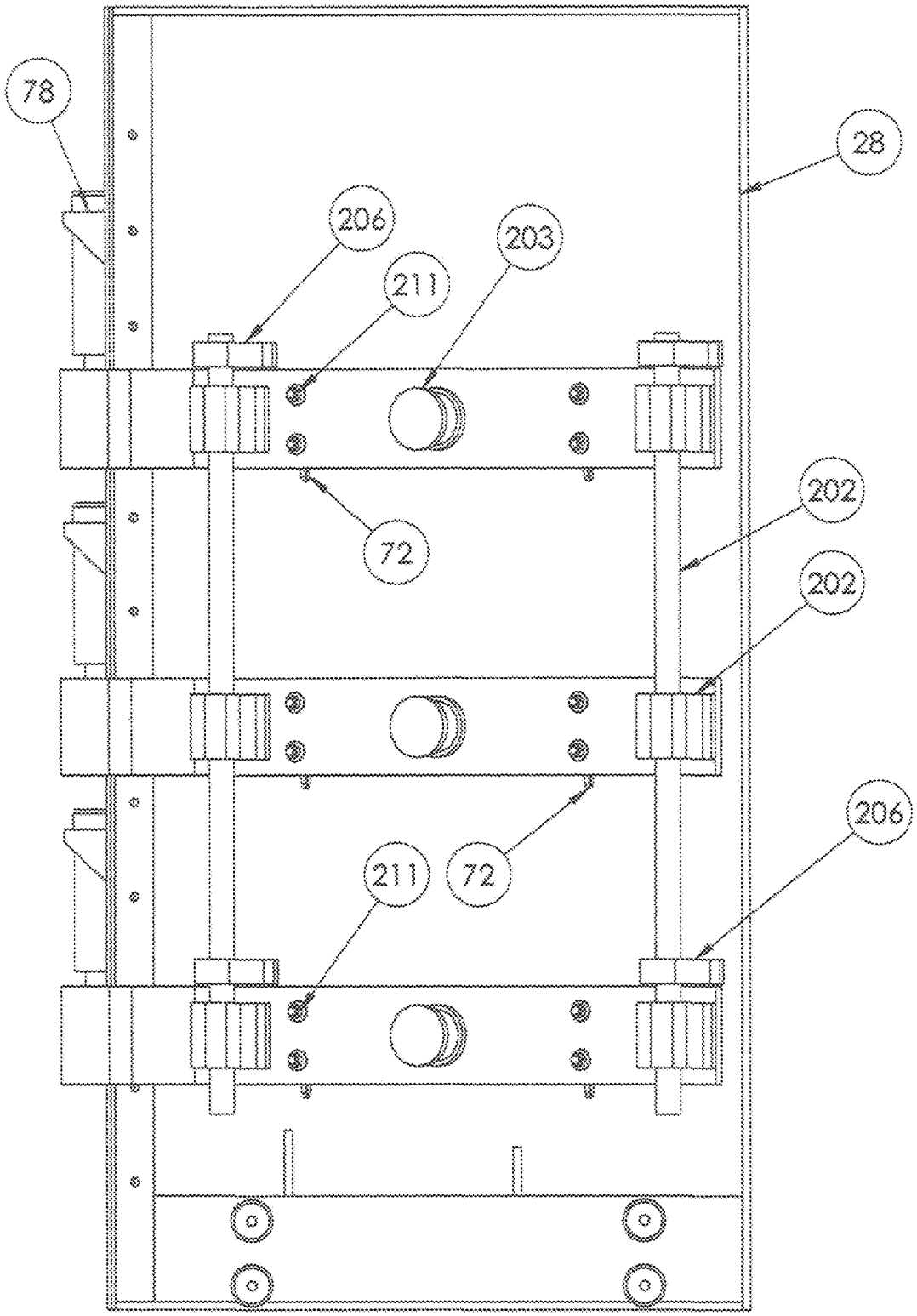
FIG. 9 is a side elevation of an exterior sidewall panel showing automated motion control of a deflector.
Figure 10:
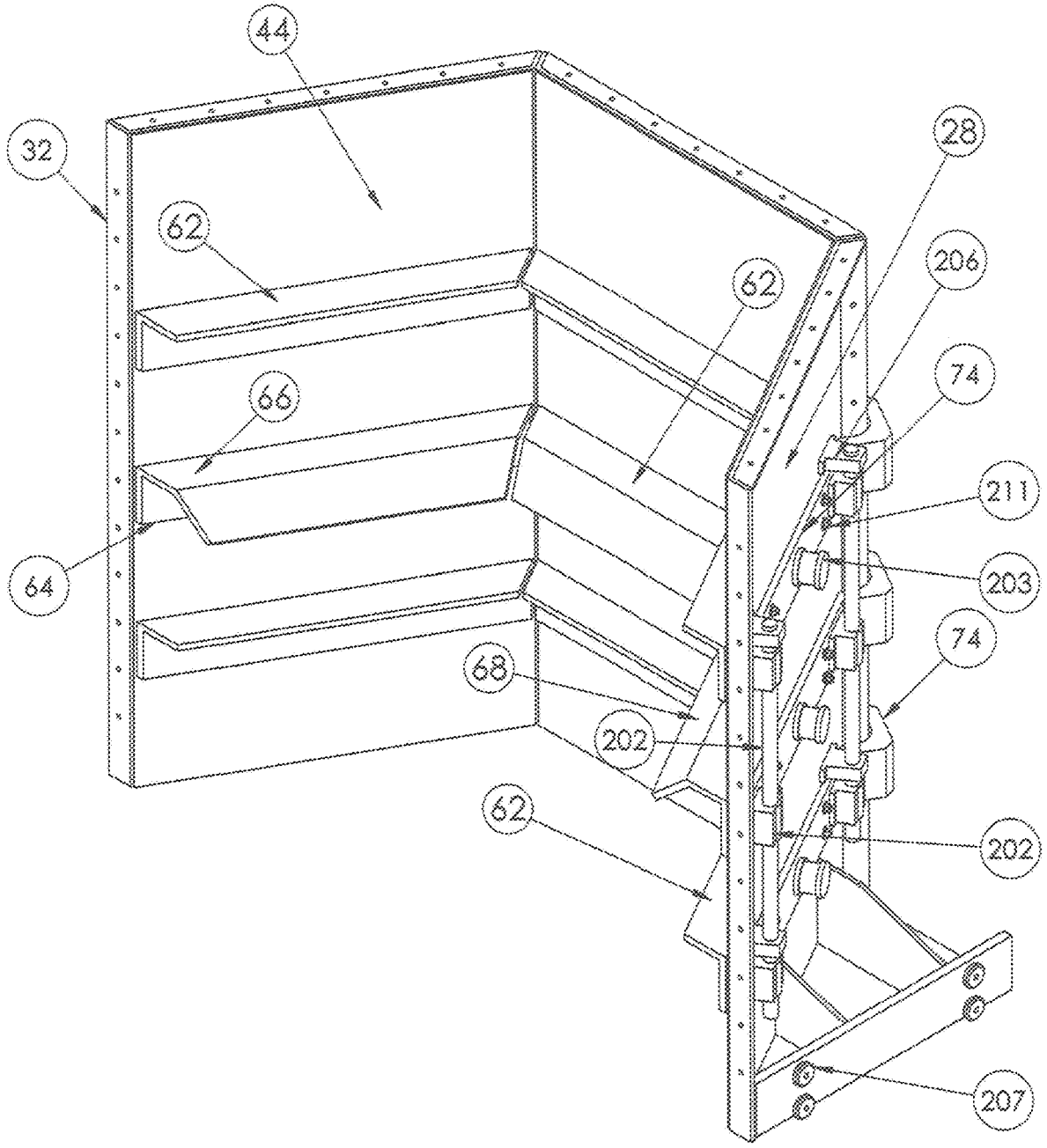
FIG. 10 is a inside perspective view of the housing showing three ranks of deflectors.
Figure 11:
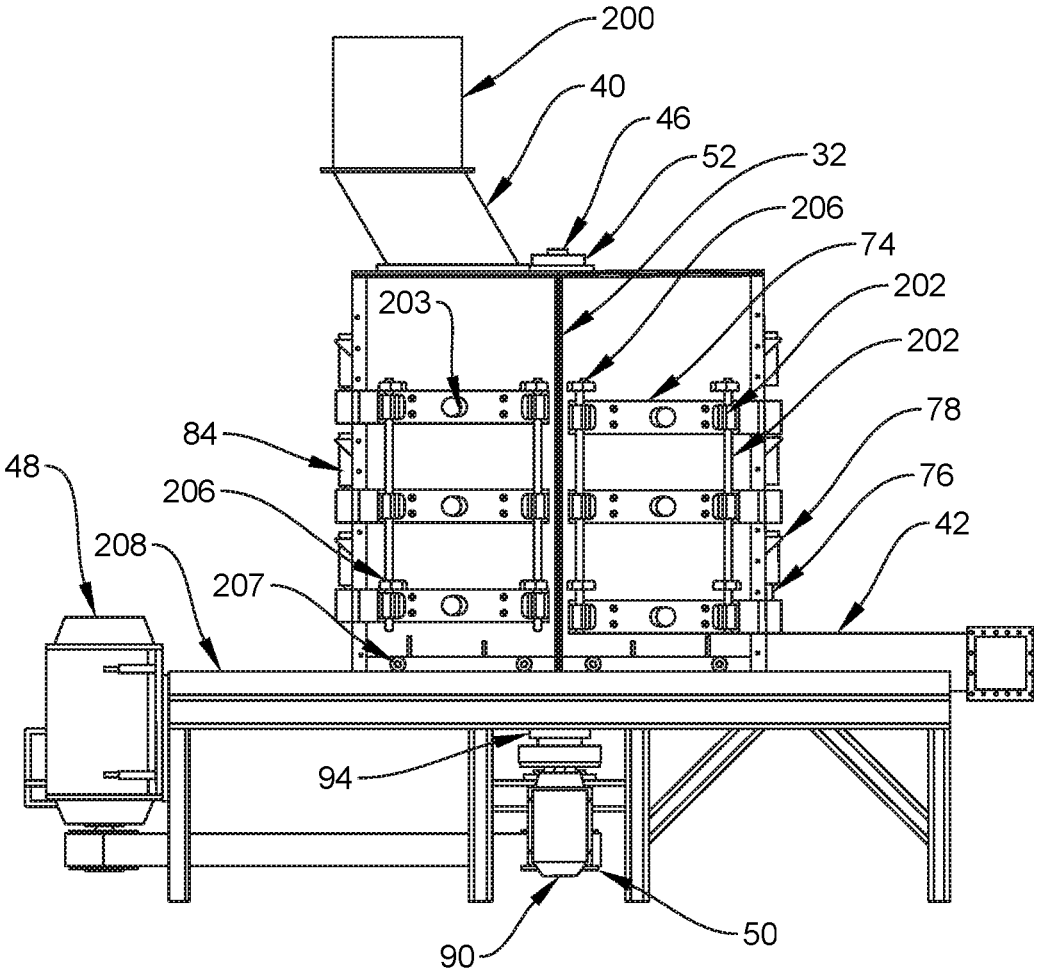
FIG. 11 is side elevation of the grinder in accordance with the present invention showing the general alignment of the main shaft motor/drive sheave with the main shaft/driven sheave and the position of the concentric shaft motor.
Figure 12:
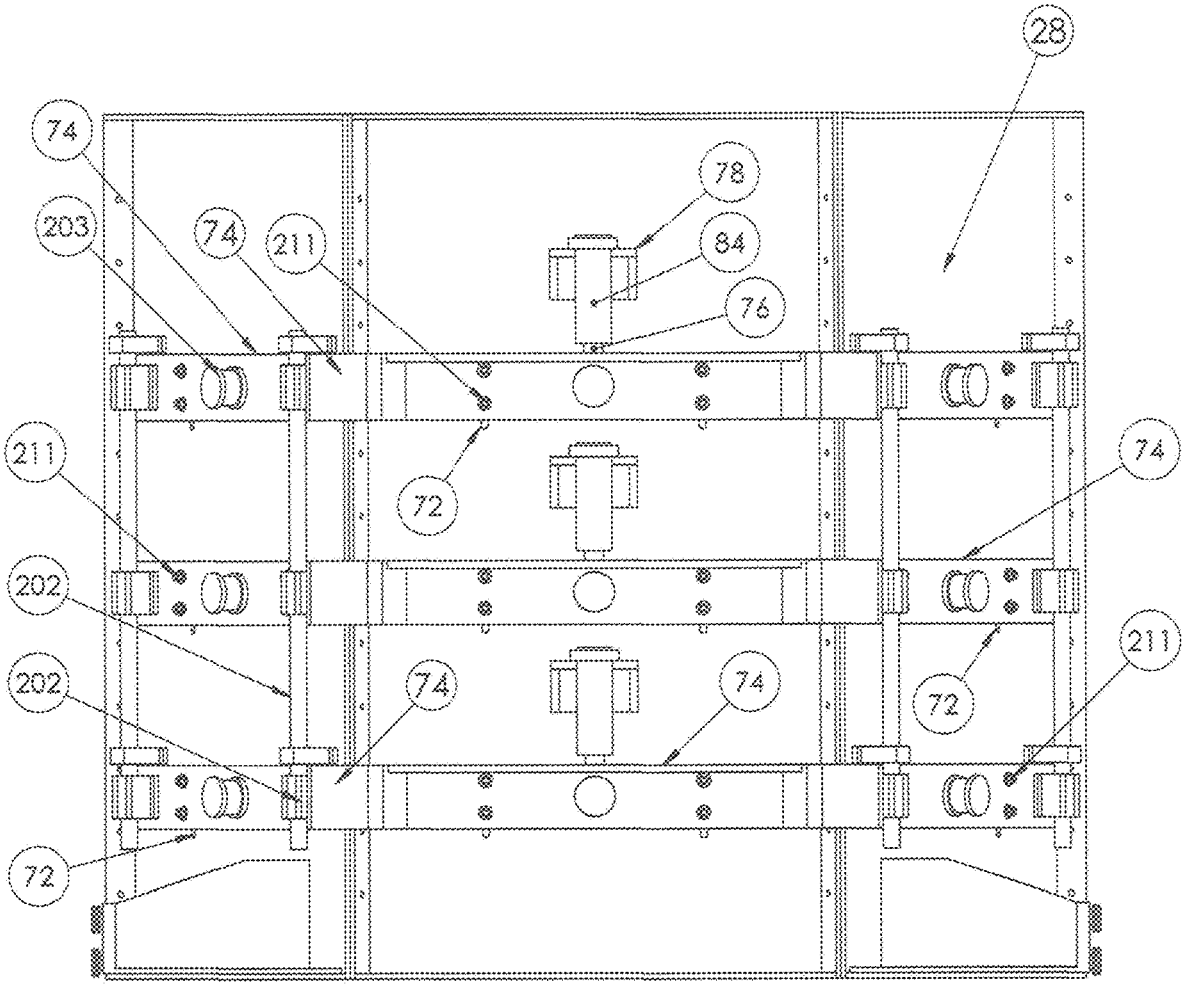
FIG. 12 is a side elevation showing the complete deflector assembly with motorized vertical position controller.
Figure 13A:
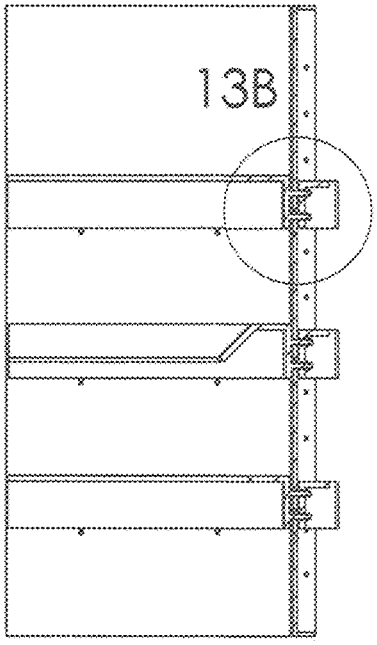
FIG. 13A is a sectional view taken along the plane of 13A-13A in FIG. 13.
Figure 13:
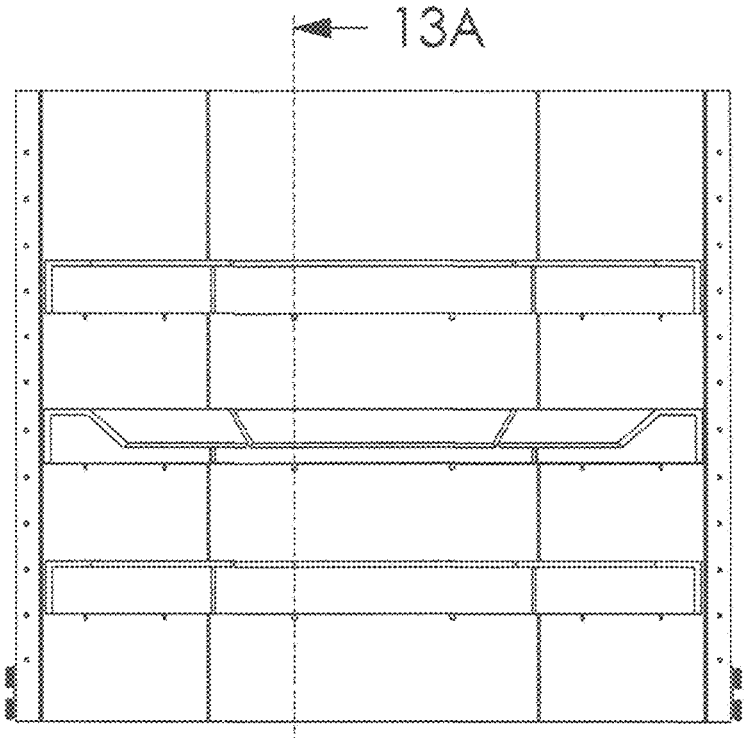
FIG. 13 is side elevation of the inside of one of the grinder sections.
Figure 13B:
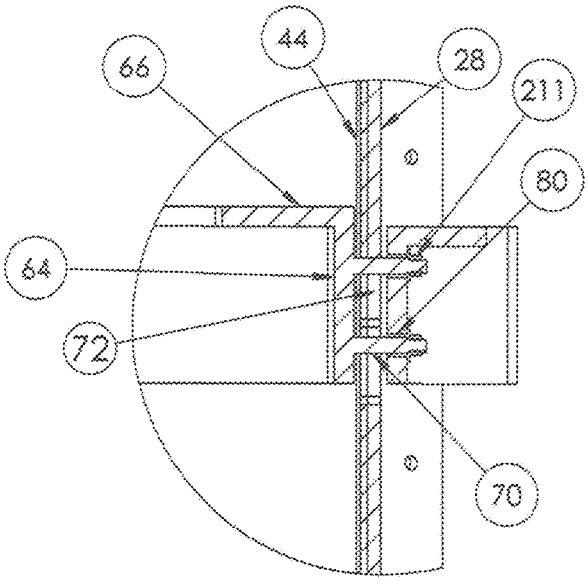
FIG. 13B is a detail on an enlarged scale taken along the line of 13B-13B in FIG. 13A.

Mounted inside interior wear plates 44 in each section 30 of housing 26 is a deflector 62 just below each cutter disc assembly. Deflectors 62 act as anvils independent of each other and are movable away from or towards interior wear plates 44. As best seen in FIG. 13B in combination with FIG. 6A wherein the wear plate and sidewall are omitted for purposes of clarity, deflectors 62 are positioned away from interior wear plates 44 with horizontal positioners 203 that when de-energized provide a small gap allowing deflector 62 vertical movements in vertical elongated wall slots 72 provided in exterior sidewall panels 28 and wear plates 44. Deflectors 62 are locked into place with horizontal positioners 203 when energized to allow for a secure connection to the interior wear plates 44. As best seen in FIGS. 8 and 9, each deflector 62 includes a vertical flange 64 positioned in abutment against an interior surface of the respective interior wear plate 44 and a horizontal flange 66 which extends inwardly from the respective section 30. Deflectors 62 are positioned such that horizontal flanges 66 are each in general alignment with cutter discs 56 such that cutting hammers 58 move in closely spaced relation to the upper surface of horizontal flange 66. As shown in FIG. 10, deflector 62 below second disc 56*b* has downwardly and inwardly extended leg 68 (e.g., 45 degrees) for deflecting material passing through the grinder towards third disc 56*c*.

The gap between horizontal flange 66 and an underside of cutting hammers 58 is critical to the size that the material is chopped and may be advantageously adjusted for the type and/or moisture content of the material passing through grinder 20. More distance results in a larger particle size, while a shorter distance yield a smaller size particle. Deflectors 62 may therefore mounted to respective interior wear plates 44 in such a manner that the position of each deflector 62 can be fine tuned to ensure proper alignment with the respective cutter disc assembly. For the purpose of adjusting the gap as seen in FIG. 13B taken in combination with FIG. 9-12, each section of deflector 62 is supported on a plurality of spaced apart bolts 70, illustrated as two which pass through oversized or elongated vertically elongated wall slots 72 provided in interior wear plates 44 and exterior sidewall panels 28. On the outside of housing 26, a deflector mounting bracket assembly 74 is provided on each of sidewall panels 28 in each section 30. Holes 80 are provided in deflector mounting bracket assembly 74 for bolts 70 to attach the sections of deflectors 62 to deflector mounting bracket assembly 74. Mounting bracket assembly 74 is supported on exterior sidewall panels 28 by vertical slide assemblies 202 that are attached to brackets 206. Brackets 206 are attached by welding or the like to the exterior walls. Mounting bracket assembly 74 is raised or lowered vertically with a vertically extending leg 76 attached to positioner 84 such as a cylinder. Bolts 70 are welded on one end to vertical flange 64 and threaded on the other end connecting exterior mounting bracket assembly 74 with a molded washer nut 211 to deflector 62. A sleeve bushing 80 over bolts 70 keeps the assembly of the two parts separated. Two position pneumatic actuators 203, with spring return positioners, when electrically energized by a solenoid push against vertical flange 64 of deflectors 62 and there is a small gap between vertical flanges 64 and the wear plates 44. The deflectors 62 are then locked into place for cutting after being positioned vertically. The solenoid is de-energized to move the deflectors 62 away from the inner wear plates to allow for vertical positioning of deflectors 62. Molded washer nut 211 will extend away from the exterior walls when horizontal positioner 203 is in the energized locked position. Molded washer nut 211 is forced against exterior deflector mounting bracket assembly 74 when horizontal positioner pneumatic actuators 203 are de-energized and plunger is retracted to allow for vertical movement of bolts 70 in vertically elongated wall slots 72.

A positioner 84 such as an electrically or hydraulically operated plunger attached to welded bracket 78 is provided for moving deflector mount bracket assembly 74 and connected deflectors 62 up and down within the range of elongated openings 72 thereby adjusting the gap between horizontal flange 66 and cutter discs 56. As illustrated, three motion controllers 84 in the form of a servo motor are attached to a center exterior sidewall panel 28 above bracket assembly 74 on each section 30. A pushrod 86 from motion controller 84 is connected to bracket assembly 74 for moving the bracket and the connected deflector up or down and adjusting the distance between deflector horizontal flange 66 and the underside of cutting hammers 58 thereby controlling the chop.

Figure 5:
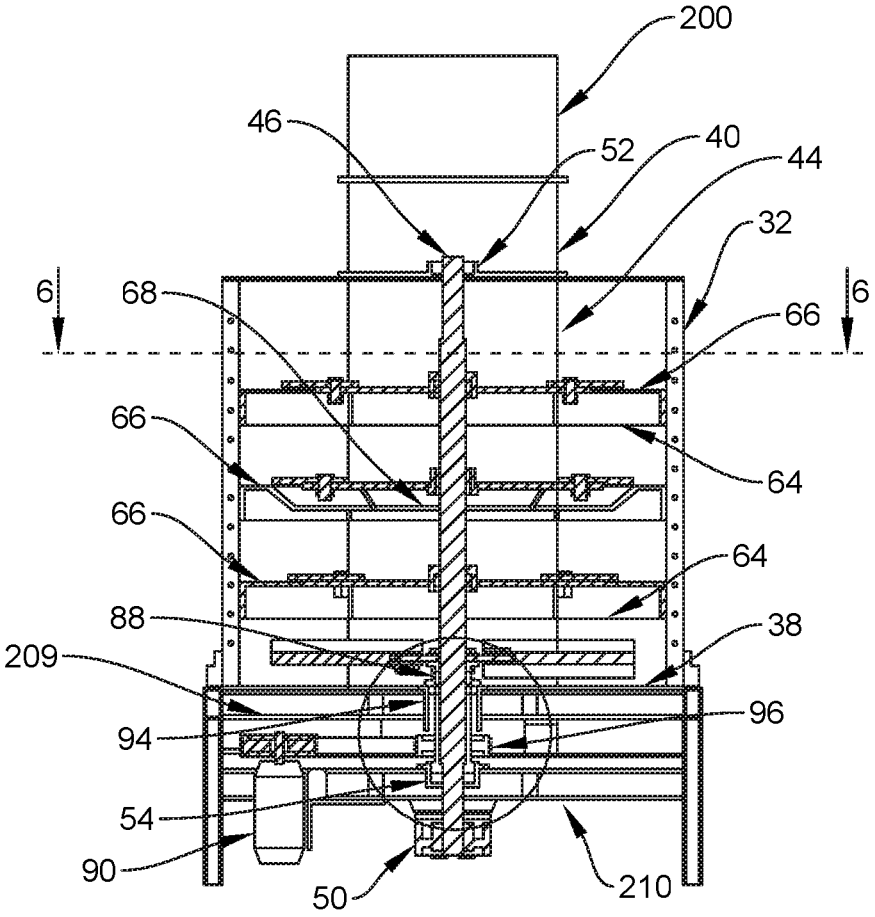
FIG. 5 is a sectional view taken along the plane of 5-5 in FIG. 4.
Figure 5A:
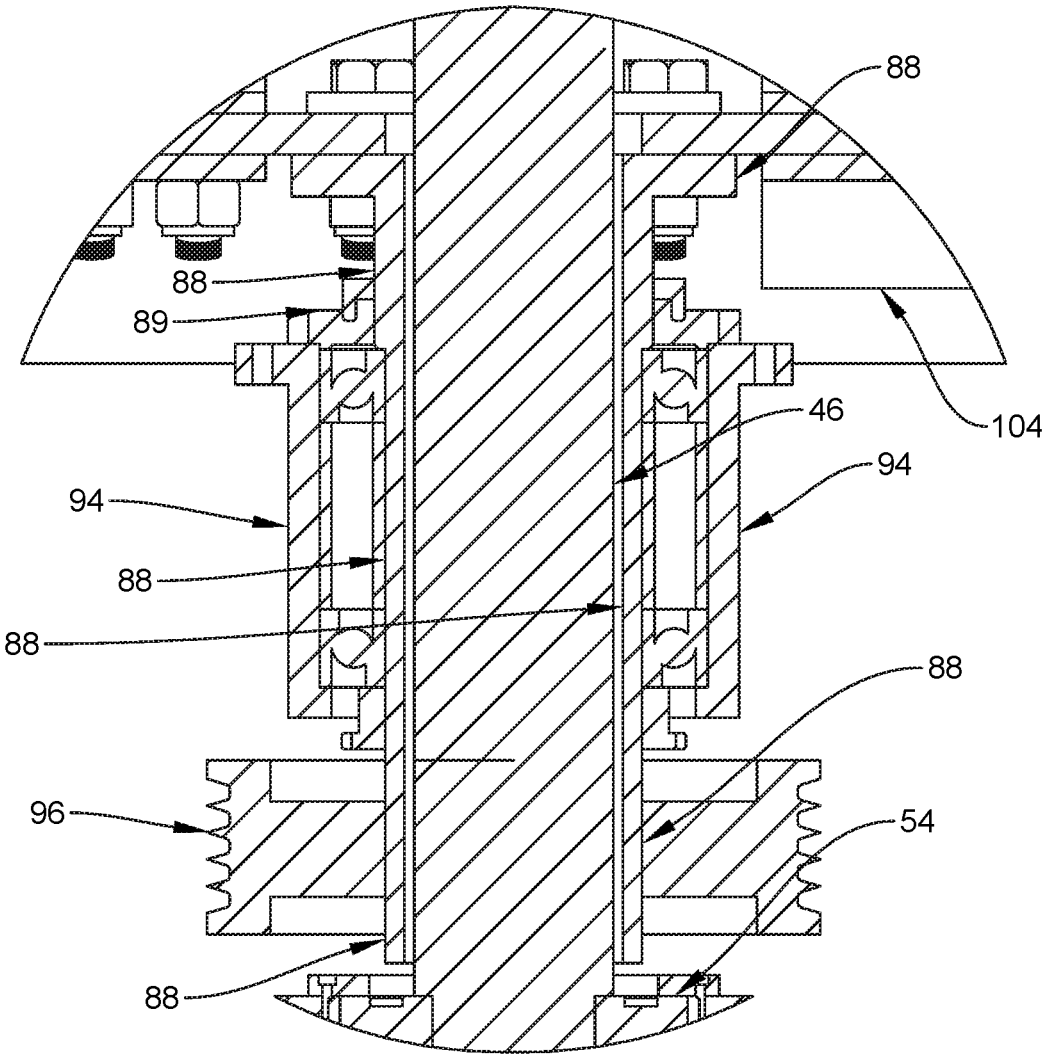
FIG. 5A is a detail on an enlarged scale taken along the line 5A-5A in FIG. 5.

Fan assembly 24 is mounted below lower cutter disc 56*c*. A fan shaft 88 is journaled for rotation by a second motor 90 in bearings 94, respectively. As best seen in FIG. 5A, fan shaft 88 and main cutting shaft 46 are concentric and fan shaft 88 is driven with a sheave pulley 96. In other embodiments, fan shaft 88 may be mounted in discharge chute 42 parallel to main cutting shaft 46. Bearing 94 is supported by bottom wall 38 and by a framework concentric bearing support 209. A plurality of fan blades 104, illustrated as four, is attached to fan shaft 88 with a direction of rotation.

In use, a programmable logic controller (PLC) 106 may be used to control cutting shaft 46 speed, the vertical position of deflector horizontal flange 66, the horizontal position of deflector 62, fan shaft 88 speed and regulate infeed and discharge conveyors appropriately—all of which are separately controllable to best suit the material being ground. Since none of these adjustments require opening up or disassembling grinder 20, they may be made dynamically as materials or conditions change. In addition, the PLC may store predefined cutting shaft speeds, fan shaft speeds and cutting heights for various infeed materials selectable through a human machine interface (HMI) 108 touch screen monitor. This degree of control is a major step forward over Watts '601 mill where only the main cutting shaft motor speed was selectable.

In the above description, numerous specific details are set forth such as examples of some embodiments, specific components, devices, methods, in order to provide a thorough understanding of embodiments of the present disclosure. It will be apparent to a person of ordinary skill in the art that these specific details need not be employed, and should not be construed to limit the scope of the disclosure. In the development of any actual implementation, numerous implementation-specific decisions must be made to achieve the developer's specific goals, such as compliance with system-related and business-related constraints. Such a development effort might be complex and time consuming, but is nevertheless a routine undertaking of design, fabrication, and manufacture for those of ordinary skill. Hence as various changes could be made in the above constructions without departing from the scope of the invention, it is intended that all matter contained in the above description or shown in the accompanying drawings shall be interpreted as illustrative and not in a limiting sense.

What is claimed:

1. A grinder having a rotor and a fan assembly mounted in a housing, said rotor having a plurality of cutter discs on a cutter shaft, each of the cutter discs having a plurality of cutting hammers mounted thereon, said grinder having a plurality of deflectors, one of said deflectors provided on the inside of the housing below each cutter disc, a deflector assembly on the outside of the housing with a first motion controller capable of independently moving the deflectors up and down for adjusting the spacing between the cutting hammers and the deflectors to produce a desired particle size reduction when a second motion controller on the outside of the housing is in a first position and the first motion controller being locked in a selected vertical position when the second motion controller is in a second position.

2. The grinder of claim 1 wherein the housing is polygonal and formed in two sections with a top wall, a bottom wall and sidewalls with wear plates on the inside of the housing sidewalls, said deflectors provided in deflector sections and being horizontally movable away from and towards the wear plates with the second motion controller on the outside of the housing, opposite ends of the deflector sections being mounted on bolts which pass through aligned elongated slots in the wear plates and sidewalls, said bolts connected to the deflector assembly, said deflector sections being movable up and down in the slots by the first motion controller when the second motion controller is in the first position and being locked in a selected vertical position when the second motion controller is in the second position.

3. The grinder of claim 2 wherein the speeds at which the cutting shaft and the fan shaft are rotated are controlled by a programmable logic controller, said programmable logic controller also controlling the first and second motion controllers.

4. The grinder of claim 3 wherein the programmable logic controller controls the cutting shaft and fan shaft speeds and for the movement of the first and second motion controllers.

5. A grinder having a rotor and a fan assembly having a fan shaft mounted in a housing, said rotor having a plurality of cutter discs mounted in a stack on a cutting shaft, said fan shaft and said cutting shaft being concentric and driven by separate motors, said housing being polygonal and formed in two housing sections with a top wall, a bottom wall and sidewalls, said housing sections having a line of division which passes through an axis of rotation of the concentric fan shaft and cutting shaft, an uppermost cutting disc in the stack having a smaller diameter than next most cutter disc and with a plurality of cutting hammers mounted on each cutter disc, a plurality of deflectors provided in deflector sections and mounted on the inside of housing below each cutter disc, a plurality of deflector assemblies on the outside of the housing each of which has a first motion controller capable of independently moving the deflector assembly up and down for adjusting the spacing between the cutting hammers and the deflectors to produce a desired particle size reduction when a second motion controller on the outside of the housing is in a first position and the first motion controller is fixed in a selected vertical position when the second motion controller is in a second position.

6. The grinder of claim 5 wherein opposite ends of each deflector are mounted on bolts which pass through elongated slots in the housing and are connected to the deflector assembly, said deflectors being movable away from and towards the inside of the housing with the second motion controller, each of said deflector sections being movable up and down in the slots by the first motion controller when the second motion controller is in the first position and fixed in a selected vertical position when the second motion controller is in the second position.

7. The grinder of claim 6 wherein the first and second motion controllers are electrical plungers.

8. The grinder of claim 5 wherein the cutting hammers have an enlarged end for attachment of the hammers to the cutting discs.

9. The grinder of claim 5 wherein said housing sections are mounted on rollers for movement on roller tracks attached to the bottom wall such that the sections may be parted along the line of division.

10. The grinder of claim 5 having a middle and lower cutter disc in addition to the uppermost cutter disc, each of the deflectors under the cutter discs in the stack having a vertical flange and a horizontal flange with the deflectors under the middle cutter disc having an inwardly extending leg attached to the horizontal flange.

11. The grinder of claim 5 wherein the speeds at which the cutting shaft and the fan shaft are rotated by the separate motors is controlled by a programmable logic controller, said programmable logic controller also controlling the first and second motion controllers.

12. The grinder of claim 6 wherein the programmable logic controller controls the cutting shaft and fan shaft speeds and the movement of the first and second motion controllers.

* * * * *